United States Patent [19]

Hellenguard et al.

[11] Patent Number: 5,068,796

[45] Date of Patent: Nov. 26, 1991

[54] CONTROL OF SHEET OPACITY

[75] Inventors: Hanh P. Hellenguard, Richmond; Lawrence J. Koth, Midlothian; Donald T. Vaughan, Richmond, all of Va.

[73] Assignee: E. I. Du Pont de Nemours and Company, Wilmington, Del.

[21] Appl. No.: 449,408

[22] Filed: Dec. 18, 1989

[51] Int. Cl.[5] ..... G06F 15/46

[52] U.S. Cl. ..... 364/469; 162/198; 162/224; 162/225; 162/DIG. 10

[58] Field of Search ..... 364/468, 469, 471; 162/198, 224, 225, 252, 262, 263, DIG. 10, DIG. 11

[56] References Cited

U.S. PATENT DOCUMENTS

| | | | |
|---|---|---|---|
| 3,169,899 | 2/1965 | Steuber | 161/72 |
| 3,442,740 | 5/1969 | David | 156/181 |
| 3,790,796 | 6/1972 | Brunton et al. | 162/263 |
| 3,847,730 | 11/1974 | Doering | 162/198 |
| 4,019,819 | 4/1977 | Lodzinski | 162/263 |
| 4,098,641 | 7/1978 | Casey et al. | 162/198 |
| 4,707,223 | 11/1987 | Sabater et al. | 162/263 |

*Primary Examiner*—Jerry Smith
*Assistant Examiner*—Thomas E. Brown

[57] ABSTRACT

A method to control the opacity of sheet formed of nonwoven material involves providing a computer with a steam pressure measurement from each of two steam heated palmer bonders. One pressure sensor from the first bonder drum and one from the second bonder drum provide signals used to control steam pressure and thus temperature of each bonder drum's surface. A signal indicating temperature of the surface of each drum and a measurement of speed are also collected by the computer/controller. The fundamental control signal is provided to the computer from an opacity sensor device which is compared to an opacity aim and then steam pressure to the bonder drum is adjusted to minimize any error signal between opacity aim measured opacity.

4 Claims, 3 Drawing Sheets

CONTROL OF SHEET OPACITY

BACKGROUND OF THE INVENTION

This invention relates to a method of on-line control of the opacity of a moving sheet material and, more particularly, to a method on-line control of the opacity of a film-fibril strand sheet material wherein the opacity of the sheet is a function of a thermal bonding finishing process applied to each side of the sheet.

U.S. Pat. No. 3,169,899 to Stueber describes the formation of film-fibril sheets by random overlapping deposition of continuous fibrillated strands. These strands described in Blades et al. U.S. Pat. No. 3,081,519 are each characterized as a three-dimensional network of film-fibrils which are interconnected at random intervals along and across the strand.

U.S. Pat. No. 3,442,740 to David describes a thermal bonding process and apparatus for film-fibril sheet material and recognizes the effect of heat treatment in a platen press upon opacity of film-fibril sheets.

U.S. Pat. No. 4,098,641 to Casey describes a method for on-line control of the opacity of paper which varies in basis weight wherein an opacity additive also varies basis weight as well as opacity.

SUMMARY OF THE INVENTION

The present invention provides a method to control in real time the opacity of a film-fibril nonwoven sheet material wherein the opacity is a function of a thermal bonding finishing process applied to each side of the sheet by passing the sheet through a modified palmer apparatus used in textile finishing. A digital computer is provided with the aim or target opacity and with a data base of variable parameters sensed at various sensor locations, one or more of which may be manipulated. The opacity of the sheet is sensed and compared to the aim opacity to produce an error signal. The manipulated variable parameter which determines opacity is adjusted to minimize the error signal.

DETAILED DESCRIPTION OF THE ILLUSTRATED EMBODIMENT

Figure 1:
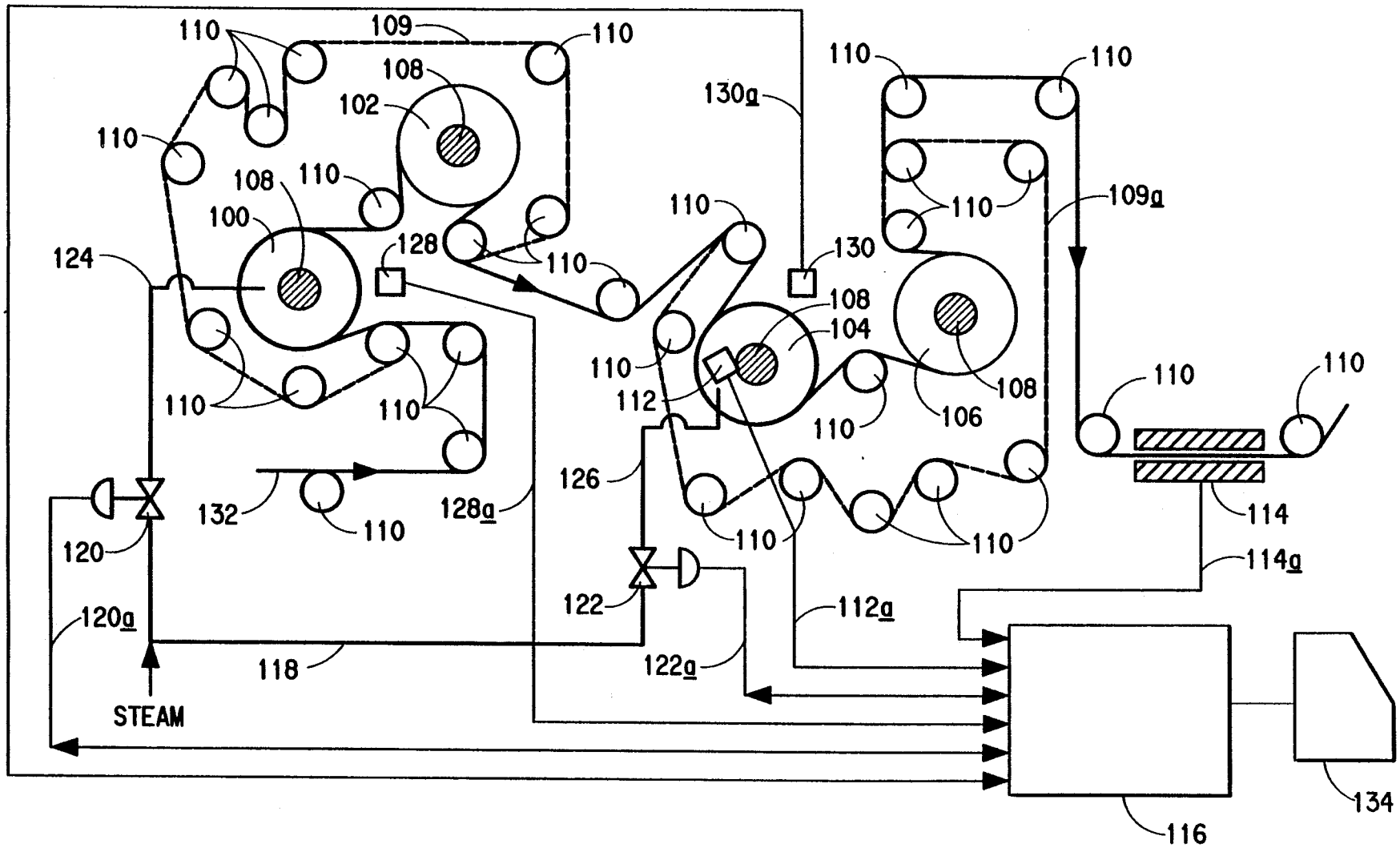
FIG. 1 is a schematic illustration of an apparatus suitable for performing the method of this invention.

In referring to FIG. 1, it will be seen that an apparatus suitable for performing the process of this invention chosen for purposes of illustration includes essentially first and second palmer finishers of the type disclosed in U.S. Pat. No. 3,442,740 operated in series to enable finishing treatment of both sides of a film-fibril sheet material 132 passing through the finishers. More particularly, the first finisher includes a first rotatable drum 100, a first rotatable quench drum 102, and an endless belt 109 which is driven by the drums 100, 102 and passes around the drums continuously by means of numerous idler rolls 110. Drum 100 is supplied with steam through control valve 120 and pipeline 124. Drum 102 is unheated. In a similar fashion a second rotatable drum 104 is associated with second quench drum 106 via endless belt 109*a* and numerous idlers 110. Drum 104 is supplied with steam through valve 122 and pipeline 126. Each drum (100, 102, 104 and 106) is also driven by a 10 HP motor 108. Steam line 118 supplies steam from a source (not shown) to control valves 120, 122.

An opacity sensor 114 is located beyond the second finisher. The signals from sensor 114 are fed to computer 116 via data line 114*a*. Non-contacting drum surface temperature sensors 128, 130 feed signals to the computer 116 via data lines 128*a*, 130*a* respectively. Output signals from the computer are fed to steam valves 120, 122 via data lines 120*a*, 122*a*, respectively. These data lines also send steam pressure signals to the computer. A remote manual input 134 is connected to the computer 116.

The major elements of the apparatus are listed in Table I below with a more detailed description of each.

| Element No. | Description | Model No. | Manufacturer |
|---|---|---|---|
| 108 | 10 HP, 240V DC Motor | Type SKH | Westinghouse |
| 112 | Tachometer | M-137 | Avtron Cleveland, OH |
| 114 | Opacity Sensor | | Measurex System Cupertino, CA |
| 116 | Computer | VAX | Digital Equipment Maynard, MA |
| 120, 122 | Pressure Control Valve | ST-3000 | Honeywell Ft. Washington, PA |
| 134 | Terminal | VT Series | Digital Equipment Maynard, MA |

In operation, the web 132 passes partially around first and second steam heated drums 100, 104 respectively and associated quench drums 102, 106 in order to be bonded on both sides. The web is held against both the heated drums and the quench drums by Dacron ® belts 109, 109*a*. Each drum is driven by a DC motor 108. The motor driving drum 104 has a tachometer 112 associated with it and the motor speed is monitored by computer 116 via data line 112*a*. From drum 106 the web 132 passes over direction rollers 110 and is directed to opacity measurement via opacity sensor 114.

The inputs to computer 116 are first drum steam pressure over data line 120*a*, second drum steam pressure over data line 122*a*, opacity signals from sensor 114 fed over data line 114*a* and temperature signals from sensors 128 and 130 via data lines 128*a*, 130*a* respectively.

Figure 2A:
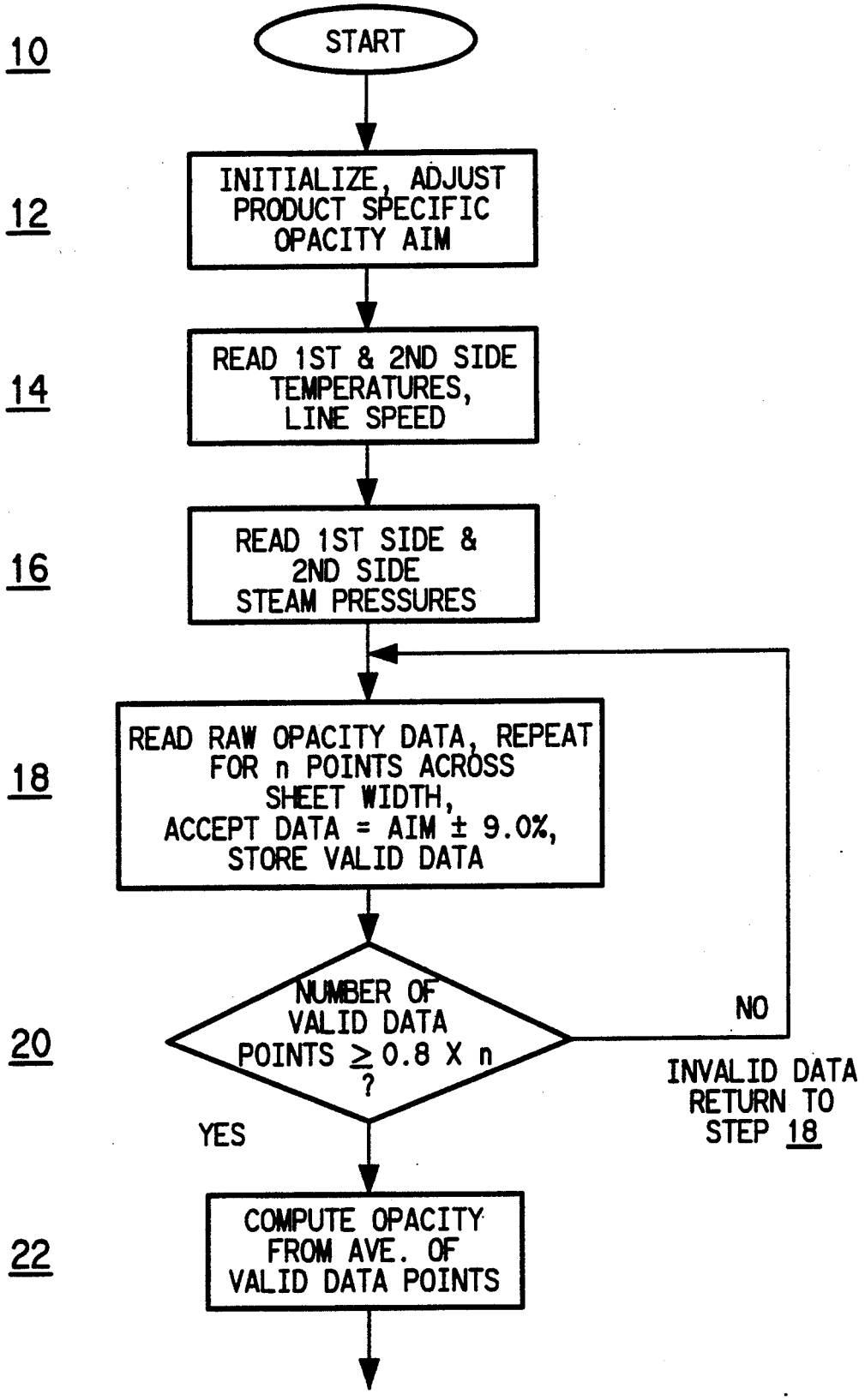
FIGS. 2*a* and 2*b* are logic flow diagrams of the computer program used to implement the method of this invention.
Figure 2B:
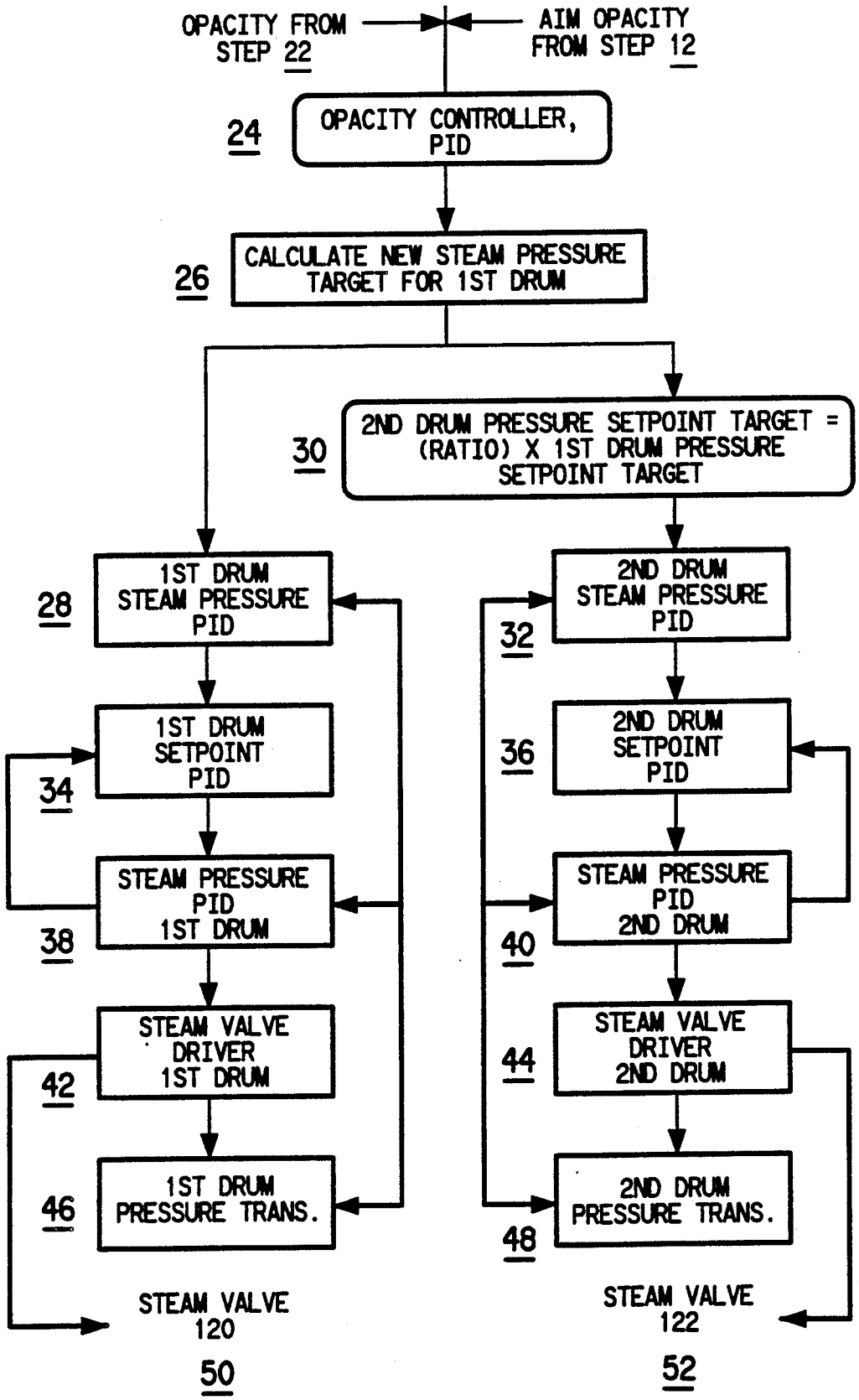

FIGS. 2*a* and 2*b* serve to illustrate the method used to control opacity of the web in real time. In FIG. 2*a* the computer is initialized at step 12 and the product opacity aim read. In step 14 the first and second side temperatures and the speed of the web moving through the process are read and archived primarily as safety features to alert operators of overheat conditions to the nonwoven sheet. The first and second side steam pressures are read in step 16 and the raw opacity data is acquired in step 18. The opacity data is acquired for n-data points across the web. For example, if the web were 130 inches wide, an opacity measurement is made at each one inch step for a total of 130 points (in this case $n=130$). Data which is $\pm 9.0\%$ of the aim value of opacity is accepted. In step 20 the data is tested for acceptability. If greater than 80% of the n-data points are valid, that is equal to aim $\pm 9.0\%$, then an average opacity for the n-data points is calculated in step 22. Otherwise, the data is declared invalid and a return to step 18 is called.

In step 24, the opacity average from step 22 and the aim opacity from step 12 are used as arguments of a proportional, integral and differential (PID) algorithm to control opacity (e.g. PID algorithms, Chapter I, sec. 1.2, Instrument Engineer's Handbook—Process Control, Edited by B. Liptak, Chilton Books, Radnor, Penna.). Those skilled in process control art and particularly with ultilization of the PID algorithm recognize that certain tuning parameters, empirically derived for a specific control application, are required inputs. Fundamentally, these tuning parameters are time constants associated with the ability of the system to respond to changes requested by the control software. Additionally, the gain of the controller which is a slope function is defined in terms of change in opacity units per change in steam pressure units. A gain for the opacity PID (step 24 in FIG. 2*b*.) is typically in the range of −0.8 to −1.5 opacity units per PSI steam pressure. The difference in current opacity average from step 22 in FIG. 2*a*. and the aim opacity from step 12 in FIG. 2*a*. provide the error signal to the opacity PID in step 24 (FIG. 2*b*.). Since the controller gain has a negative slope a measured opacity greater than aim requires an increase in steam pressure and thus temperature of the sheet bonder to bring opacity toward the aim value. The converse situation applies to measured opacity less than the aim value.

The new steam pressure target, calculated as a result in step 24, is communicated to a PID controller in step 28 for the first drum steam pressure. This PID has as an input the measured first drum steam pressure from step 46. An error signal determined from the measured steam pressure and the target pressure from step 26 are used with a PID to calculate a setpoint for steam valve 120 for the first steam heated drum. A gain of positive one is used for all steam pressure PID controllers.

The second steam heated drum receives its steam pressure set point target via step 30 where a steam pressure target is calculated from the first drum steam pressure target from step 26. Typically, the target steam pressures are identical. The ability to vary steam pressures, and thus temperatures, in the first and second steam heated drums is introduced by the ratio in step 30. The steam pressure target for the first side drum is multiplied by an empirically determined ratio in step 30, this product determines the second side steam pressure target communicated to step 32. The ratio is typically unity but may be less than or greater than one. Ratioes other than unity may be selected for bonding a nonstandard basis weight of material or to introduce a difference in bonding between first and second sides of the sheet material.

Similar feedback loops in steps 38 and 40 are used in conjunction with another PID algorithm to determine the steam pressure control signal to be communicated to the steam valves 120 and 122 via steam pressure control valve drivers in steps 42 and 48.

The control method of this invention provides a real-time means to control sheet opacity to some predetermined level. In the manual method originally used, an initial steam pressure was estimated to bond a nonwoven sheet formed web. Samples were then taken and measured offline, using an Eddy opacity meter, to determine if the desired opacity was obtained. If opacity was off aim, steam pressure was adjusted, samples taken and measured again. This manual process was repeated until the predetermined opacity level as achieved. But at the expense of wasted material. The rule of thumb used to manually adjust steam pressure was 1 psi gave 1.5% change in opacity. This meant a measured opacity 1.5% below the opacity aim required a steam pressure reduction 1 psi and vice versa. However, this manually applied heuristic did not take into account differences in unit weights, processing speeds, nor process conditions that produced the nonwoven web. Consequently, the manual method did not provide a timely remedial action due to the offline measurement requirement. Typically, an acceptable opacity with ±1% tolerance was achieved after several hours of trial and error using the manual procedure. The online measurement and control method developed by this invention provides an on-aim opacity with ±0.2% tolerance in fewer than 5 minutes from the time aim opacity is read into the system.

EXAMPLE

A series of runs (1 through 6 below in tabular form) illustrate the parameters used in control of opacity of a nonwoven sheet formed material by means of this invention. The starting material was a nonbonded, lightly consolidated, sheet of flash spun linear polyethylene plexifilaments, having a melting point of 135 degrees C., a melt index of 0.9 and a density of 0.95 g/cm$^3$; as prepared by general methods disclosed by Blades, U.S. Pat. No. 3,081,519. The unit weight of the unbonded nonwoven sheet was in the range of about 52 to about 92 g/m$^2$. The opacity of the unbonded sheet was 95–97%, as measured by an off-line testing procedure using an E. B. Eddy Opacity Meter disclosed by C. Lee in U.S. Pat. No. 4,310,591. An additional off-line test for delamination strength performed using an Instron Integrator, also disclosed by Lee in U.S. Pat. No. 4,310,591 was used to determine the change in delamination strength for a given change in opacity for nonwoven sheets processed under similar conditions. The rolls of as formed nonwoven sheet, only lightly consolidated, were fed at a speed in the range of 150 to 250 m/min to the bonding units. Saturated steam at a pressure of about 60 to about 80 psia was available for heating the bonding drums (the ratio of first and second side steam pressures in the control algorithm was defined to be unity). Compressional restraint in the bonders is provided by Dacron® belts, each is 15 feet wide and 90.5 feet in length and measuring about 0.25 inch thickness. In order to provide an aim opacity in the range of 83–91%±0.2% for the bonded nonwoven sheet, the first and second side drums had a nominal measured surface temperature in the range of 128 to 145 degrees C. The final bonded sheets had an increased unit weight, in the range of about 54 to about 97 g/m$^2$, due to increased consolidation of plexifilimentary strands comprising the sheet 74.6 g/m$^2$. The opacity as determined by off-line testing was within the tolerance of the aim value (about ±0.2% of the measured value) of opacity sought using this automatic control method.

EXAMPLE DATA TABLE

| Run No. | 1 | 2 | 3 | 4 | 5 | 6 |
|---|---|---|---|---|---|---|
| Unbonded unit weight | | | | | | |
| g/m$^2$ | 52.90 | 62.75 | 66.12 | 72.57 | 72.57 | 92.24 |
| (oz/yd$^2$) | 1.56 | 1.85 | 1.95 | 2.14 | 2.14 | 2.72 |
| Unbonded opacity, % | 95.0 | 95.0 | 95.0 | 96.0 | 96.0 | 97.0 |
| Bonded pressure | | | | | | |
| 1st drum, bars | 4.34 | 4.83 | 4.69 | 4.9 | 5.1 | 5.3 |
| (psia) | 63.0 | 70.0 | 68.0 | 71.0 | 74.0 | 77.0 |

-continued

| EXAMPLE DATA TABLE | | | | | | |
|---|---|---|---|---|---|---|
| Run No. | 1 | 2 | 3 | 4 | 5 | 6 |
| Bonded pressure | | | | | | |
| 2nd drum, bars | 4.34 | 4.83 | 4.69 | 4.9 | 5.1 | 5.3 |
| (psia) | 63.0 | 70.0 | 68.0 | 71.0 | 74.0 | 77.0 |
| Machine speed | | | | | | |
| m/min | 228.6 | 155.5 | 192.0 | 137.2 | 192.0 | 146.3 |
| (yd/min) | 250.0 | 170.0 | 210.0 | 150.0 | 210.0 | 160.0 |
| Drum 1 surface | | | | | | |
| temp., deg C. | 128.0 | 139.0 | 135.0 | 141.0 | 139.0 | 145.0 |
| (deg F.) | 262.4 | 282.2 | 275.0 | 285.8 | 282.2 | 293.0 |
| Drum 2 surface | | | | | | |
| temp., deg C. | 128.0 | 139.0 | 135.0 | 141.0 | 139.0 | 145.0 |
| (deg F.) | 262.4 | 282.2 | 275.0 | 285.8 | 282.2 | 293.0 |
| Bonded sheet unit | | | | | | |
| weight, $g/m^2$ | 54.25 | 64.43 | 67.82 | 74.60 | 74.60 | 96.64 |
| ($oz/yd^2$) | 1.6 | 1.9 | 2.0 | 2.20 | 2.20 | 2.85 |
| Bonded opacity, % | 91.0 | 83.2 | 90.5 | 84.4 | 88.0 | 83.0 |
| Bonded delamination | | | | | | |
| g/cm | 48.26 | 84.00 | 57.20 | 87.58 | 71.50 | 132.27 |
| (lb/inch) | 0.27 | 0.47 | 0.32 | 0.49 | 0.40 | 0.74 |

What is claimed is:

1. A computer-aided method for on-line control of opacity of a moving non-woven sheet of film-fibril strand material wherein the opacity is a function of a thermal bonding finishing process applied to each side of the sheet bypassing one side of the sheet around and in contact with a first rotatable driven drum heated to a first bonding temperature by steam supplied under pressure from a first variable position steam valve, then passing the other side of the sheet around and in contact with a second rotatably driven drum heated to a second bonding temperature by steam supplied under pressure from a second variable position steam valve, the method comprising:

providing the computer with an aim opacity level;

providing the computer with a data base including the following parameters by sensing at sensor locations;

first drum temperature first drum steam pressure second drum temperature second drum pressure speed of the sheet opacity measurements at n locations across the width of the sheet after passing the second drum;

repetitively determining the values of said parameters as the sheet passes around the first and second drums;

repetitively providing the computer with the values of said parameters;

comparing opacity aim with the average opacity of n locations across the sheet to produce an opacity error signal; and adjusting first and second steam drum pressures which determine the degree of thermal bonding which in turn affects opacity of said moving non-woven sheet to minimize the opacity error signal.

2. The method of claim 1 wherein said second steam drum pressure is adjusted to a value equal to said first steam drum pressure.

3. The method of claim 1 wherein said second steam drum pressure is adjusted to a value greater than said first steam drum pressure.

4. The method of claim 1 wherein said second steam drum pressure is adjusted to a value less than said first steam drum pressure.

* * * * *